US007416252B2

(12) United States Patent
Lor

(10) Patent No.: US 7,416,252 B2
(45) Date of Patent: Aug. 26, 2008

(54) BACKPOST UNIT OF WOODEN DINING CHAIR WITH RECLINING MECHANISM

(75) Inventor: Lean Sen Lor, Penang (MY)

(73) Assignee: Green Continental Furniture (M) SDN BHD, Kulim, Kedah (MY)

( * ) Notice: Subject to any disclaimer, the term of this patent is extended or adjusted under 35 U.S.C. 154(b) by 0 days.

(21) Appl. No.: 11/619,542

(22) Filed: Jan. 3, 2007

(65) Prior Publication Data

US 2007/0278841 A1 Dec. 6, 2007

Related U.S. Application Data

(63) Continuation-in-part of application No. 10/500,467, filed on Jul. 15, 2004, now abandoned.

(30) Foreign Application Priority Data

Jan. 17, 2002 (MY) ..... PI 20020178
May 20, 2002 (WO) ..... PCT/SG02/00101

(51) Int. Cl.
*A47C 3/025* (2006.01)
*A47C 1/024* (2006.01)
*A47C 1/033* (2006.01)

(52) U.S. Cl. ..... 297/285; 297/289; 297/291; 297/292; 297/293; 297/296; 297/297; 297/299; 297/301.1; 297/301.2; 297/301.4; 297/354.1

(58) Field of Classification Search ..... 297/285, 297/289, 291, 292, 293, 296, 297, 299, 301.1, 297/301.2, 301.4, 301.5, 354.1
See application file for complete search history.

(56) References Cited

U.S. PATENT DOCUMENTS 44,987 A * 11/1864 Staples ..... 297/296 X
136,956 A * 3/1873 Baughman et al. ..... 297/301.4
197,567 A * 11/1877 Schrenkeisen ..... 297/292
317,295 A * 5/1885 Carter ..... 297/301.4
334,087 A * 1/1886 Price ..... 297/285
349,907 A * 9/1886 Shults ..... 297/292
376,886 A * 1/1888 Holden ..... 297/292
404,628 A * 6/1889 James ..... 297/296

(Continued)

FOREIGN PATENT DOCUMENTS

DE 3839455 A1 * 5/1990 ..... 297/285

(Continued)

OTHER PUBLICATIONS

US 14,634, 03/1856, McLauthlin (withdrawn)*

*Primary Examiner*—Rodney B. White
(74) *Attorney, Agent, or Firm*—Dicke, Billig & Czaja, PLLC

(57) ABSTRACT

A backpost for use in wooden dining chair. The backpost unit provides reclining movements for a wooden chair of the type having a stationary frame section within which the backpost unit is secured. The backpost unit consists of an interlocking mechanism with minimum components and requires minimum maintenance and provides a solid and reliable reclining mechanism. The chair enables the user to secure an accurate posture of sitting during eating and also enables the user to enjoy a relaxing posture while sitting on the same dining chair.

17 Claims, 6 Drawing Sheets

U.S. PATENT DOCUMENTS

| | | | | | |
|---|---|---|---|---|---|
| 431,098 | A | * | 7/1890 | Wilson | 297/301.4 |
| 740,825 | A | * | 10/1903 | Dorney | 297/292 |
| 812,051 | A | * | 2/1906 | Lanagan | 297/285 |
| 960,607 | A | * | 6/1910 | Werel | 297/293 |
| 1,150,189 | A | * | 8/1915 | Heater | 297/293 |
| 1,278,643 | A | * | 9/1918 | Hasty et al. | 297/301.4 |
| 1,336,510 | A | * | 4/1920 | Collier | 297/301.4 |
| 1,368,469 | A | * | 2/1921 | Atwood | 297/301.4 |
| 1,388,291 | A | * | 8/1921 | Nicklaus | 297/301.4 |
| 1,663,898 | A | * | 3/1928 | Bitzenburger | 297/301.4 |
| 1,744,258 | A | * | 1/1930 | Bitzenburger | 297/301.4 |
| 1,767,042 | A | * | 6/1930 | Bitzenburger | 297/301.4 |
| 1,767,757 | A | * | 6/1930 | Harris | 297/285 X |
| 1,793,045 | A | * | 2/1931 | Bitzenburger | 297/289 X |
| 1,816,486 | A | * | 7/1931 | Johnson | 297/292 |
| 1,829,434 | A | * | 10/1931 | Bair | 297/301.4 |
| 1,926,259 | A | * | 9/1933 | Bitzenburger | 297/301.4 |
| 1,960,156 | A | * | 5/1934 | Kelly | 297/301.4 |
| 2,587,822 | A | * | 3/1952 | Corning | 297/301.1 X |
| 3,743,352 | A | * | 7/1973 | Kallander | 297/285 |
| 4,084,850 | A | * | 4/1978 | Ambasz | 297/317 |
| 4,157,203 | A | * | 6/1979 | Ambasz | 297/285 X |
| 4,333,683 | A | * | 6/1982 | Ambasz | 297/292 |
| 4,379,589 | A | * | 4/1983 | Marino | 297/299 |
| 4,408,800 | A | * | 10/1983 | Knapp | 297/301.2 |
| 4,533,177 | A | * | 8/1985 | Latone | 297/285 X |
| 4,549,764 | A | * | 10/1985 | Haedo | 297/296 |
| 4,580,836 | A | * | 4/1986 | Verney | 297/296 |
| 4,589,697 | A | * | 5/1986 | Bauer et al. | 297/301.2 |
| 4,641,885 | A | * | 2/1987 | Brauning | 297/292 X |
| 4,703,974 | A | * | 11/1987 | Brauning | 297/285 |
| 4,733,910 | A | * | 3/1988 | Brennan | 297/285 |
| 4,756,575 | A | * | 7/1988 | Dicks | 297/285 X |
| 4,787,676 | A | * | 11/1988 | Neve de Mevergnies | 297/285 X |
| 4,830,430 | A | * | 5/1989 | Schafer | 297/296 X |
| 4,856,846 | A | * | 8/1989 | Lohmeyer | 297/285 |
| 4,869,552 | A | * | 9/1989 | Tolleson et al. | 297/296 |
| 5,039,163 | A | * | 8/1991 | Tolleson | 297/297 |
| 5,069,496 | A | * | 12/1991 | Kunh et al. | 297/301.2 |
| 5,100,200 | A | * | 3/1992 | Keusch et al. | 297/296 |
| 5,100,201 | A | * | 3/1992 | Becker et al. | 297/296 X |
| 5,108,149 | A | * | 4/1992 | Ambasz | 297/297 X |
| 5,114,210 | A | * | 5/1992 | Naess | 297/285 X |
| 5,340,197 | A | * | 8/1994 | Vogtherr | 297/285 X |
| 5,419,615 | A | * | 5/1995 | Dozsa-Farkas | 297/301.2 |
| 5,452,937 | A | * | 9/1995 | Piretti | 297/301.4 |
| 5,580,127 | A | * | 12/1996 | Piretti | 297/291 X |
| 5,649,739 | A | * | 7/1997 | Zapf | 297/301.1 |
| 5,704,688 | A | * | 1/1998 | Schrewe et al. | 297/285 |
| 5,887,946 | A | * | 3/1999 | Raftery | 297/297 |
| 5,904,397 | A | * | 5/1999 | Fismen | 297/291 |
| 5,988,746 | A | * | 11/1999 | Raftery | 297/297 |
| 6,056,361 | A | * | 5/2000 | Cvek | 297/296 X |
| 6,116,686 | A | * | 9/2000 | Luo | 297/286 |
| 6,149,236 | A | * | 11/2000 | Brauning | 297/301.2 |
| 6,406,096 | B1 | * | 6/2002 | Barile, Sr. | 297/296 X |
| 6,471,293 | B2 | * | 10/2002 | Ware et al. | 297/285 X |
| 6,533,352 | B1 | * | 3/2003 | Glass et al. | 297/299 |
| 6,679,551 | B2 | * | 1/2004 | Ware et al. | 297/285 X |
| 6,715,834 | B1 | * | 4/2004 | Liao | 297/301.2 X |
| 6,739,663 | B2 | * | 5/2004 | Gevaert | 297/296 |
| 6,820,934 | B2 | * | 11/2004 | Ware et al. | 297/285 |
| 6,896,327 | B1 | * | 5/2005 | Barile, Sr. | 297/297 |
| 6,951,370 | B1 | * | 10/2005 | Hsu | 297/301.2 X |
| 7,104,607 | B2 | * | 9/2006 | Yasuda et al. | 297/285 X |
| 2006/0202534 | A1 | * | 9/2006 | Heidmann et al. | 297/354.1 |
| 2006/0202535 | A1 | * | 9/2006 | Heidmann et al. | 297/354.1 |

FOREIGN PATENT DOCUMENTS

| | | | | | |
|---|---|---|---|---|---|
| EP | 552388 | A1 | * | 7/1993 | 297/296 |
| GB | 2150825 | A | * | 7/1985 | 297/296 |
| WO | WO 9103192 | A1 | * | 3/1991 | 297/296 |

* cited by examiner

BACKPOST UNIT OF WOODEN DINING CHAIR WITH RECLINING MECHANISM

REFERENCE TO RELATED APPLICATION

This patent application is a continuation-in-part of U.S. application Ser. No. 10/500,467, filed Jul. 15, 2004, the specification of which is incorporated herein by reference.

FIELD OF INVENTION

The present invention relates generally to a backpost unit of a wooden dining chair having a reclining mechanism that allows reclining movements to the backpost unit. The backpost unit can be self assembled or DIY ready, as a part of a DIY wooden dining chair. The backpost unit can recline at a range of angles and automatically retract to its original position when the force is removed.

BACKGROUND OF INVENTION

This invention relates to backpost unit of a wooden dining chair, which has a reclining mechanism that provides extra comfort for user. The mechanism enables user to recline at certain range of angle if user press his/her back against the backpost of the wooden dining chair.

There are a variety of prior chairs that include mechanisms that permit a chair back to recline. For example, Ambasz, U.S. Pat. Nos. 4,084,850; 4,157,203; 4,333,683; and 5,108,149, each disclose chairs where a portion of the chair back pivots in response to a force from a person sitting on the chair. Each of the Ambasz chairs is fabricated from non-wooden materials.

Staples, U.S. Pat. No. 44,987, and Shults, U.S. Pat. No. 349,907, each discuss reclining chairs that use a spring to control pivoting of an upper portion of the chair back.

In the Staples chair, the spring is placed behind the top and bottom portions of the chair back. Shults teaches placing the top and bottom portions of the chair back beside each other.

Conventional wooden dining chair is designed to have an upright position or with a small angled rigid backpost, such design enables the user to be at the best sitting posture or best natural position for eating, however, eating is just one of the activities that can happen at dining table. In fact, most of the times we spend at dining table are involve in non-eating activities like drinking, discussion, meeting, playing card games and family bonding.

Therefore, the limitation of the upright rigid design of backpost on a wooden dining chair with the original intention to support optimum upright posture will not provide comfort for activities other than eating. Therefore, it is the intention of this invention to address the above-mentioned limitation of a dining chair.

It is therefore an object of the invention to provide a backpost with a simple reclining mechanism installed inside a wooden dining chair that enables users to adjust themselves to their desirable reclining position.

It is an object of the invention to provide a mechanism to enable the backpost of a wooden dining chair to recline and automatically retracts to it's original position once the reclining force is removed.

It is a further object of the invention to provide a backpost unit for a wooden dining chair that consists of simple interlocking mechanism with minimum components and requires minimum maintenance, and providing a solid and reliable reclining mechanism.

These and other objects and advantages of the invention will be apparent to those of ordinary skill in the art upon inspection of the detailed description, drawings and appended claims.

SUMMARY OF INVENTION

The object of the invention is to provide a backpost unit for use in wooden dining chair of the type having a stationary frame section within which the backpost unit is secured.

In one embodiment, the backpost unit is made of one piece of same material that is cut a top backpost portion and a bottom backpost portion. Intermediate the top backpost portion and the bottom backpost portion is a rear facing gap is provided to accommodate a reclining mechanism.

The reclining mechanism is installed at contact area between the top backpost portion and the bottom backpost portion. A hinge type linkage means is embedded inside the backpost extended between the top backpost portion and the bottom backpost portion and to permit the top backpost portion to recline relative to the bottom backpost portion.

In another embodiment, the reclining mechanism could be hidden or embedded inside the backpost. A resilient means is installed within the rear facing gap and interposed between the bottom surface of the top backpost portion and the top surface of the bottom backpost portion to enable the top backpost portion to recline according to pressure exerted by a user and to revert to its original position upon removal of the pressure.

It is another object of the invention to provide a casing to cover up the rear facing gap and conceal the resilient means installed inside. Advantageously, the reclining mechanism enables the users to relax their back in a range of angles while remain sitting at the dining table.

DETAIL DESCRIPTION OF EMBODIMENTS

Figure 1:
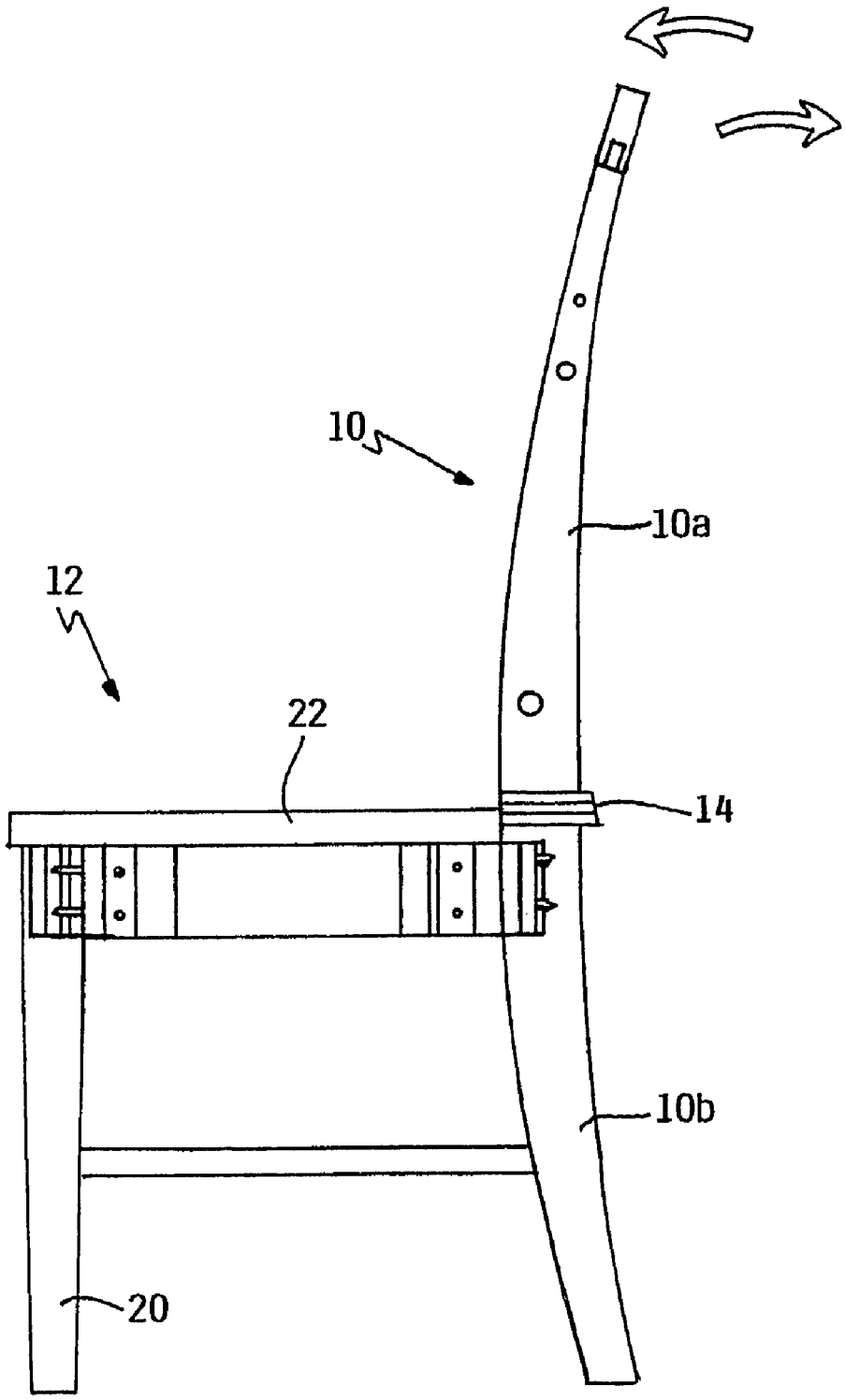
FIG. 1 is a side view of a wooden dining chair incorporating a backpost unit when no force is applied to the backpost unit.
Figure 2:
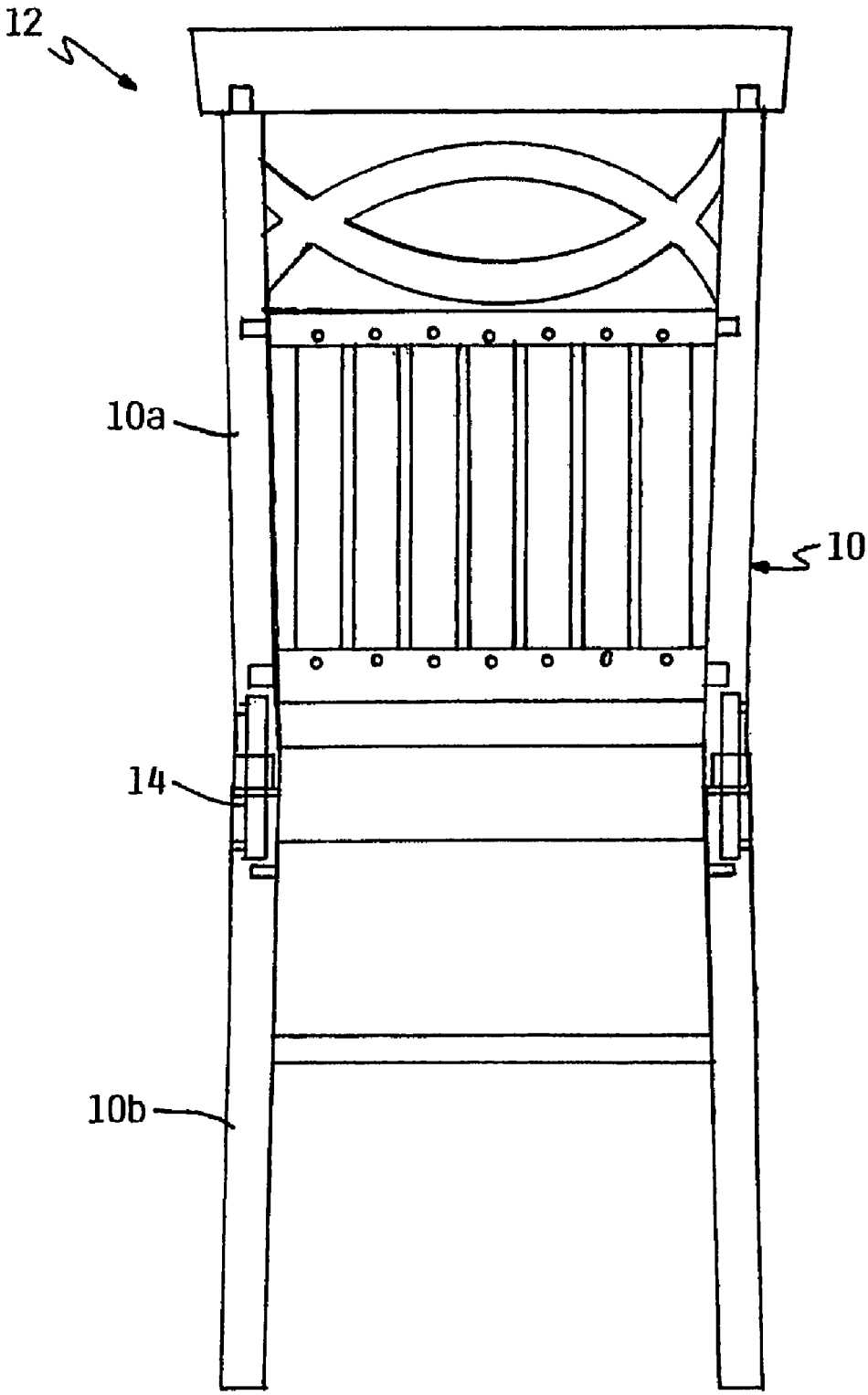
FIG. 2 is a front view of the wooden dining chair incorporating the backpost unit when no force is applied to the backpost unit.
Figure 3:
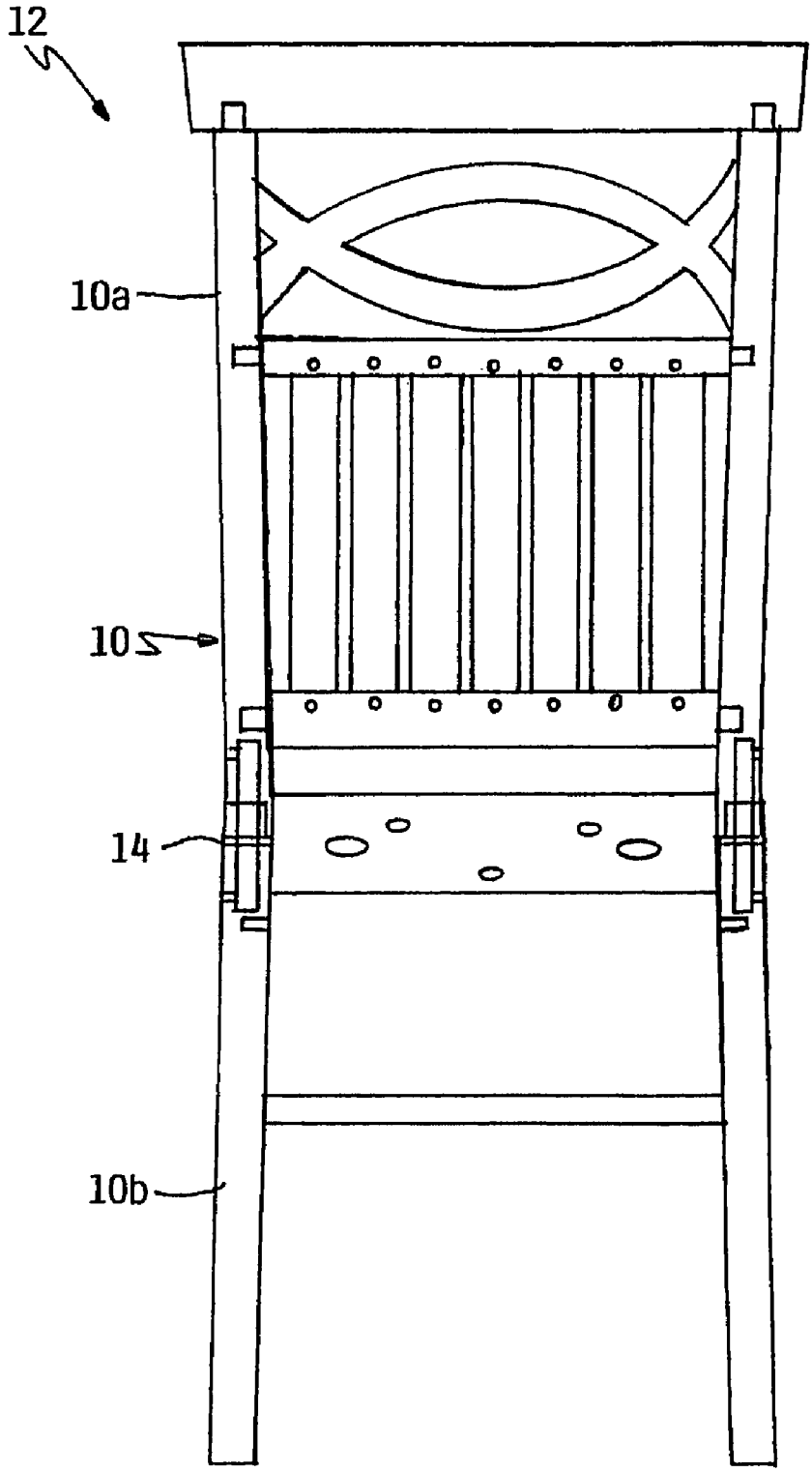
FIG. 3 is a back view of the wooden dining chair incorporating the backpost unit when no force is applied to the backpost unit.

FIGS. 1-3 show side, front and back views of a backpost unit 10 as part of a wooden dining chair 12 in upright position when no pressure is applied to the backpost unit 10. The backpost unit 10 includes a top backpost portion 10*a* and a bottom backpost portion 10*b* that are interconnected with a reclining mechanism 14. In addition to the backpost unit 10, the wooden dining chair 12 may also include a frontpost unit 20 and a seat 22.

Figure 4:
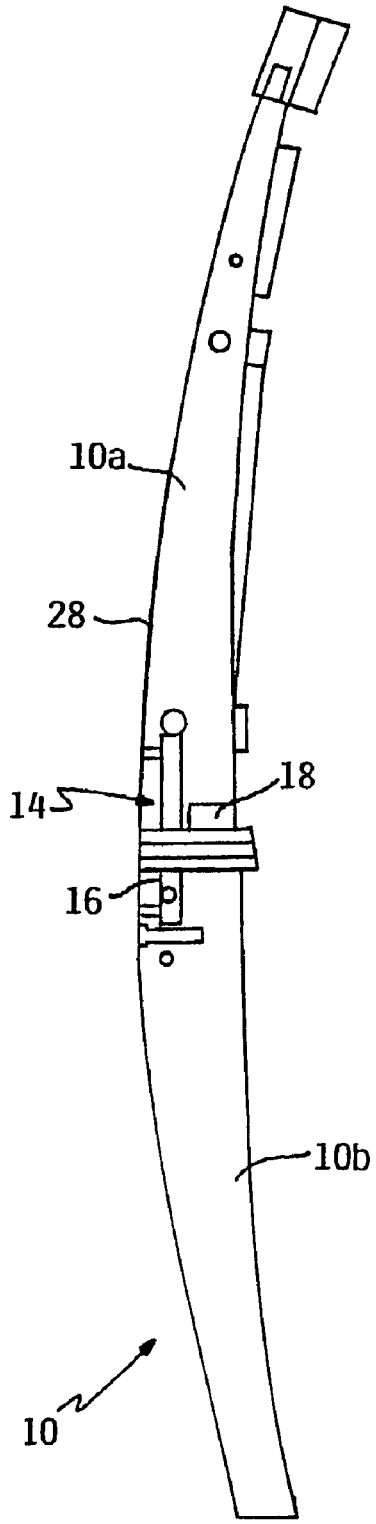
FIG. 4 is a side view of a post in the backpost unit when no force is applied to the backpost unit.
Figure 5:
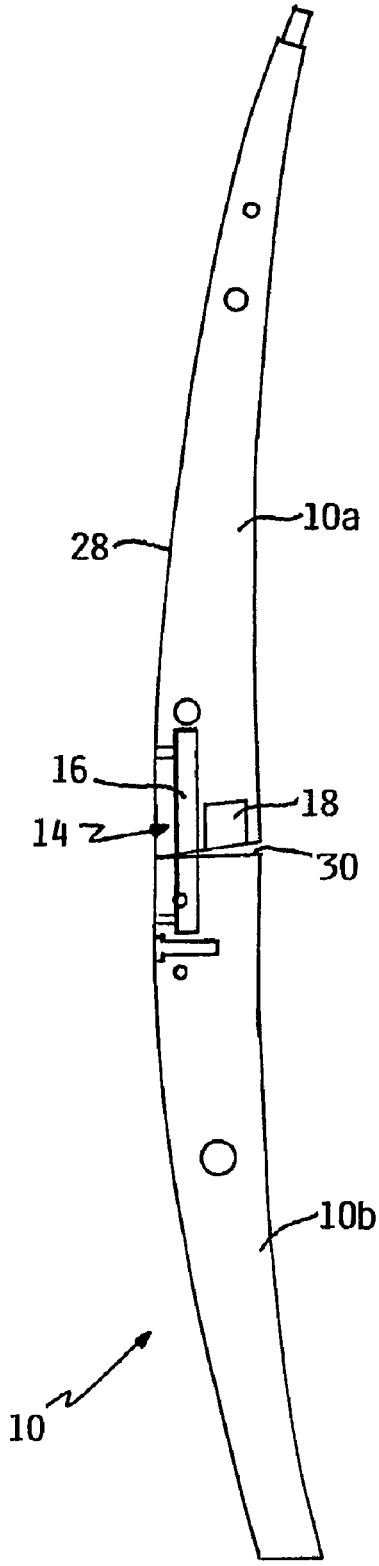
FIG. 5 is a side view of the post in the backpost unit when a force is applied to the backpost unit.

Forming the backpost unit 10 in this configuration provides a user with excellent support whether the user is in the upright dining position (FIG. 4) or the reclined position (FIG. 5). The position of the reclining mechanism 14 in the wooden backpost unit 10 not only provides a strong configuration but eliminates the potential of the user being pinched on the front and back sides of the backpost unit 10. Additionally, incorporating the reclining mechanism 14 into the wooden backpost unit 10 provides the wooden dining chair 12 with an enhanced aesthetic appearance.

Because of the structure, the backpost unit 10 as well as the other components of the wooden dining chair 12 can be self assembled or DIY ready, as a part of a DIY wooden dining chair 12 and recline at a range of angles and automatically retract to its original when the force is removed. None of the prior reclining chair designs appreciate the benefits associated with the combination of the preceding elements.

The figures illustrate an embodiment whereby the backpost unit 10 is also acting as legs for supporting the wooden dining chair 12. The novel part of this invention is the reclining mechanism 14 is installed within the backpost unit 10 in a concealed manner and yet makes the wooden dining chair 12 looks like having a solid piece back post, as most clearly illustrated in FIGS. 4-6.

The reclining mechanism 14 generally includes a hinge type linkage means 16 and a resilient means 18. The hinge type linkage means 16 is embedded inside with minimum the backpost unit 10 and requires minimum maintenance, and providing a solid and reliable reclining mechanism.

An upper leaf 16*a* of the hinge type linkage means 16 is extended into the top backpost portion 10*a* and a lower leaf 16*b* of the hinge type linkage means 16 is extended into the bottom backpost portion 10*b*. A hinge pin 16*c* is provided intermediate the upper leaf 16*a* and the lower leaf 16*b* to pivotally attached the upper leaf 16*a* to the lower leaf 16*b*. This configuration thereby permits the top backpost portion 10*a* to recline relative to the bottom backpost portion 10*b*.

Figure 6:
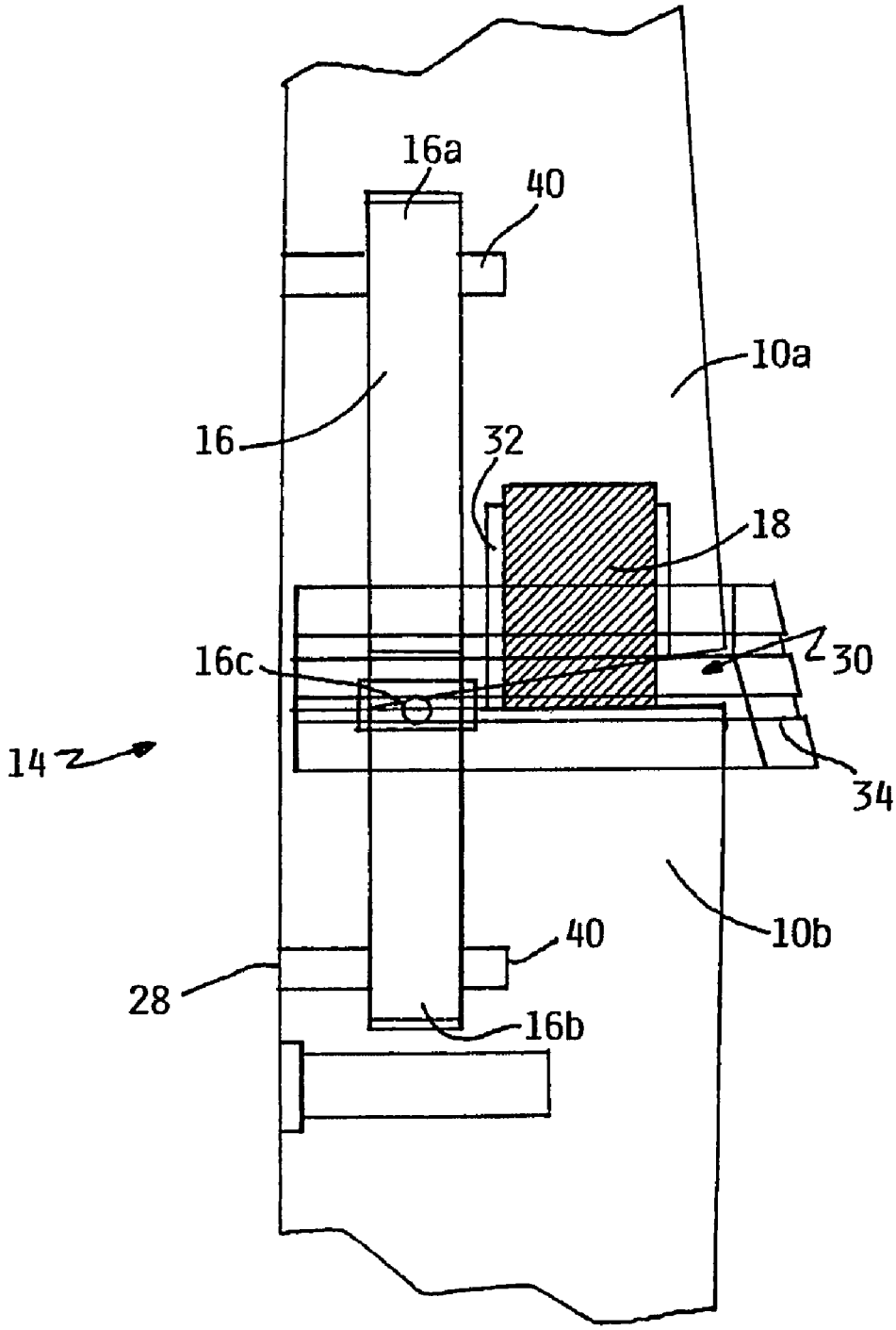
FIG. 6 is an enlarged view of a reclining mechanism taken from FIG. 1.

FIGS. 4-6 shows a side view of the backpost unit 10 with the embedded reclining mechanism 14. The backpost unit 10 is made of one piece of wooden material that is cut into the top backpost portion 10*a* and the bottom backpost portion 10*b*, with a rear facing gap 30 to accommodate the reclining mechanism 14 at contact area between the top backpost portion 10*a* and the bottom backpost portion 10*b*. The hinge type linkage means 16 is embedded inside the backpost unit 10 extended between the top backpost portion 10*a* and the bottom backpost portion 10*b* and for permitting the top backpost portion 10*a* to recline relative to said bottom backpost portion 10*b*.

The backpost unit 10 thereby provides a substantially continuous backrest surface 28 on a front side thereof. The substantially continuous backrest surface 28 provides support for a person sitting on the wooden dining chair 12 while eliminating potential pinch points at the intersection of the top backpost portion 10*a* and the bottom backpost portion 10*b*, which could result in injury to the person sitting on the wooden dining chair 10. Mounting the hinge type linkage means 16 proximate the backrest surface 28 assists in maintaining the substantially continuous backrest surface 28 even when the force is applied to the top backpost portion 10*a*.

As most clearly illustrated in FIG. 6, the resilient means 18 is installed within the rear facing gap 30 and interposed between a bottom surface of the top backpost portion 10*a* and a top surface of the bottom backpost portion 10*b* to enable the top backpost portion 10*a* to recline according to pressure exerted by a user and to revert to its original position upon removal of the pressure. The resilient means 18 may be made of material contain high elasticity property selecting from the group consisting of plastics or rubbers.

A recess 32 may be provided in the lower surface of the top backpost portion 10*a* or the upper surface of the bottom backpost portion 10*b* to receive a portion of the resilient means 18. Forming the recess 32 enables the resilient means 18 to be formed with a greater size than if the resilient means 18 was merely placed between the lower surface of the top backpost portion 10*a* and the upper surface of the bottom backpost portion 10*b*.

Forming the resilient means 18 with a larger size enhances the ability of the backpost unit 10 to providing cushion while the top backpost portion 10*a* is reclined with respect to the bottom backpost portion 10*b*. This configuration thereby enhances the user's comfort associated with reclining the backpost unit 10.

Forming the backpost unit 10 with the integrated reclining mechanism 14 also enhances the durability of the wooden dining chair 12 because the user is able to recline the top backpost portion 10*a* with respect to the bottom backpost portion 10*b* and thereby increase the comfort of the wooden dining chair 12 without the need to tilt the entire wooden dining chair backwards so that only the back legs contact the ground surface. Especially with wooden dining chairs, tilting the wooden dining chairs onto the back legs often leads to premature breakage of the wooden dining chairs.

It is another object of the present to provide a casing 34 to cover up the rear facing gap 30 and conceal the resilient means 18 installed inside and further make the backpost unit 10 looks like a single solid piece of wooden backpost for a dining chair. In addition to enhancing the appearance of the backpost unit 10, the casing 34 also prevents users from being pinched between the top backpost portion 10*a* and the bottom backpost portion 10*b* during reclining.

It is a further object of the present invention to provide the backpost unit 10 for the wooden dining chair 12 that consists of simple interlocking mechanism with minimum components and requires minimum maintenance, and providing a solid and reliable reclining mechanism 14. The wooden dining chair 12 using the interlocking mechanism 14 as described in this invention exhibits a high degree of strength and stability.

To facilitate readily attaching the hinge type linkage means 16 to the top backpost portion 10*a* and the bottom backpost portion 10*b*, a pair of lock pins 40 is provided, as illustrated in FIG. 6. One of the lock pins 40 extends through an aperture in the top backpost portion 10*a* and an aperture in the upper leaf 16*a* and one of the lock pins 40 extends through an aperture in the bottom backpost portion 10*b* and an aperture in the lower leaf 16*b*. The lock pins 40 can be a simple rod pin or screw.

Figure 9:
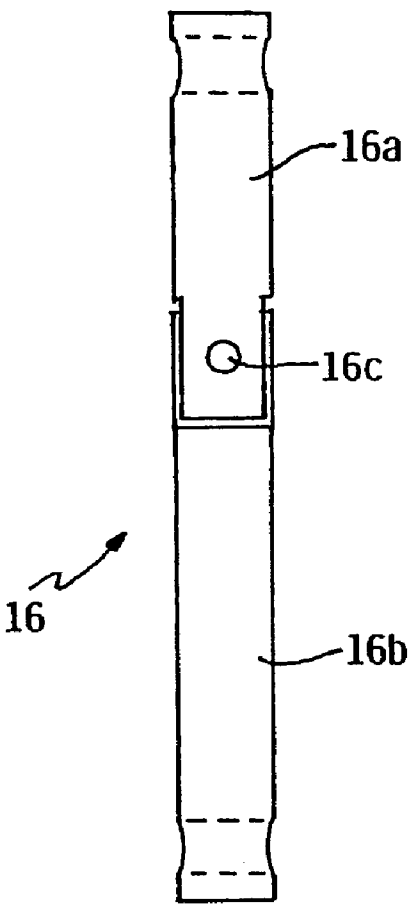
FIG. 9 is a side view of the hinge mechanism.
Figure 8:
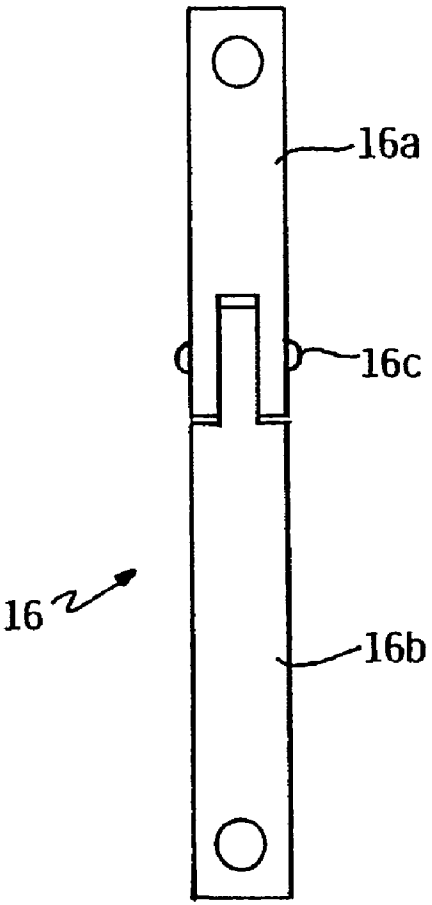
FIG. 8 is a front view of the hinge mechanism.
Figure 7:
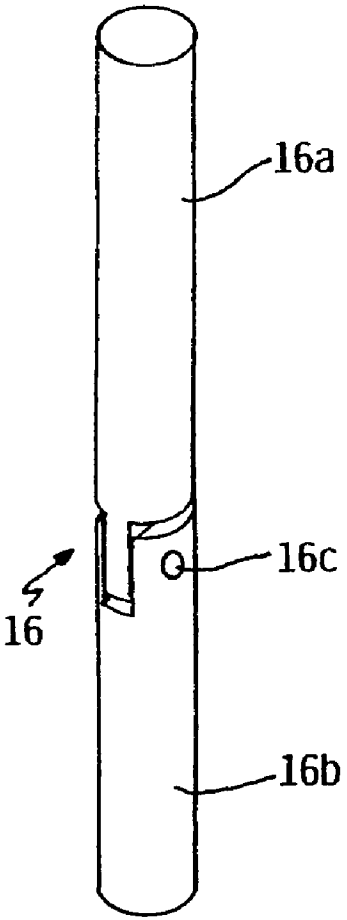
FIG. 7 is a perspective view of a hinge mechanism from the backpost unit.

The hinge type linkage means 16 preferable has a cylindrical configuration, as most clearly illustrated in FIGS. 7-9. Forming the hinge type linkage means with this configuration enables the hinge type linkage means 16 to be incorporated in the top backpost portion 10*a* and the bottom backpost portion 10*b* using a conventional drill bit. This configuration enhances the strength of the backpost unit 10 because the surface of the upper leaf 16*a* is substantially adjacent to the surface of the aperture in the top backpost portion 10*a* and the surface of lower leaf 16*b* is substantially adjacent to the surface of the aperture in the bottom backpost portion 10*b*.

In the preferred and alternate embodiments of the present invention have now been described in detail. It is to be noted, however, that this description of these specific embodiments is merely illustrative of the principles underlying the inventive concept.

It is therefore contemplated that various modifications of the disclosed embodiments will, without departing from the spirit and scope of the invention, be apparent to persons skilled in the art. For instance, it is obvious the one skilled in the art of the present invention that alternate embodiments of the present dining chair can include different shape and means of reclining mechanism.

The invention claimed is:

1. A wooden backpost unit for use in a wooden dining chair of the type having a stationary frame section within which the backpost unit is secured for providing reclining movement therein, wherein the backpost unit comprises:

a hinge type linkage means having an upper leaf and a lower leaf that are pivotally connected with a hinge pin;

a top backpost portion having a top aperture formed in a lower surface thereof that is adapted to receive the upper leaf;

a bottom backpost portion having a bottom aperture formed in an upper surface thereof that is adapted to receive the lower leaf;

an upper lock pin engaging the upper leaf and the top backpost portion to retain the upper leaf and the top backpost portion in a stationary relationship with respect to each other;

a lower lock pin engaging the lower leaf and the bottom backpost portion to retain the lower leaf and the bottom backpost portion in a stationary relationship with respect to each other, wherein the top backpost portion and the bottom backpost portion when interconnected with the hinge type linkage means provides a substantially continuous backrest surface on a front surface thereof and a rear facing gap on a back surface thereof;

a resilient means installed within the rear facing gap, wherein the hinge type linkage means is located intermediate the resilient means and the backrest surface, wherein the hinge type linkage means and the resilient means allow the top backpost portion to recline according to pressure exerted by a user and to revert to its original position upon removal of said pressure; and a casing attached to at least one of the top backrest portion and the bottom backrest portion to substantially the resilient means and hinge type linkage means.

2. The backpost unit of claim 1, wherein the hinge type linkage means provides a pivot point that is proximate the backrest surface.

3. The backpost unit of claim 2, wherein the upper leaf and the lower leaf each have a cylindrical profile, and wherein the top aperture and the bottom aperture each have a cylindrical profile.

4. The backpost unit of claim 1, wherein the top aperture substantially conforms to a surface of the upper leaf, and wherein the bottom aperture substantially conforms to a surface of the lower leaf.

5. The backpost unit of claim 1, wherein the backpost unit is also acting as legs for supporting the wooden dining chair.

6. The backpost unit of claim 1, wherein at least one of the top backpost portion and the bottom backpost portion have an aperture formed therein that is adapted to receive a portion of the resilient means.

7. The backpost unit of claim 1, wherein the resilient means is rubber or synthetic rubber.

8. The backpost unit of claim 1, wherein the casing covers up the rear facing gap, resilient means, hinge type linkage means to make the backpost to appear as a single piece solid backpost unit.

9. The backpost unit of claim 1, wherein the backpost unit can be self assembled as part of a self assembled wooden dining chair.

10. A wooden backpost unit for use in a wooden dining chair of the type having a stationary frame section within which the backpost unit is secured for providing reclining movement therein, wherein the backpost unit comprises:

a hinge type linkage means having an upper leaf and a lower leaf that are pivotally connected with a hinge pin, wherein the upper leaf and the lower leaf each have a cylindrical profile;

a top backpost portion having a top aperture formed in a lower surface thereof that is adapted to receive the upper leaf, wherein the top aperture has a cylindrical profile;

a bottom backpost portion having a bottom aperture formed in an upper surface thereof that is adapted to receive the lower leaf, wherein the bottom aperture has a cylindrical profile, wherein the top backpost portion and the bottom backpost portion when interconnected with the hinge type linkage means provides a substantially continuous backrest surface on a front surface thereof and a rear facing gap on a back surface thereof;

a resilient means installed within the rear facing gap, wherein the hinge type linkage means is located intermediate the resilient means and the backrest surface, wherein the hinge type linkage means and the resilient means allow the top backpost portion to recline according to pressure exerted by a user and to revert to its original position upon removal of said pressure; and a casing attached to at least one of the top backrest portion and the bottom backrest portion to substantially cover the resilient means and the hinge type linkage means.

11. The backpost unit of claim 10, wherein the hinge type linkage means provides a pivot point that is proximate the backrest surface.

12. The backpost unit of claim 10, wherein the top aperture substantially conforms to a surface of the upper leaf, and wherein the bottom aperture substantially conforms to a surface of the lower leaf.

13. The backpost unit of claim 10, wherein the backpost unit is also acting as legs for supporting the wooden dining chair.

14. The backpost unit of claim 10, wherein at least one of the top backpost portion and the bottom backpost portion have an aperture formed therein that is adapted to receive a portion of the resilient means.

15. The backpost unit of claim 10, wherein the resilient means is rubber or synthetic rubber.

16. The backpost unit of claim 10, wherein the casing covers up the rear facing gap, resilient means, hinge type linkage means to make the backpost unit to appear as a single piece solid backpost unit.

17. The backpost unit of claim 10, wherein the backpost unit can be self assembled as part of a self assembled wooden dining chair.

* * * * *